US005163266A

United States Patent [19]

Herzog

[11] Patent Number: 5,163,266

[45] Date of Patent: Nov. 17, 1992

[54] AIR CLUTCH CAPPER SPINDLE

[76] Inventor: Kenneth J. Herzog, 200 Mill Rd., Riverhead, N.Y. 11901

[21] Appl. No.: 733,616

[22] Filed: Jul. 22, 1991

[51] Int. Cl.[5] ..... B65B 07/28; B67B 03/20

[52] U.S. Cl. ..... 53/317; 53/331.5; 192/56 F

[58] Field of Search ..... 192/56 F; 53/317, 318, 53/331.5

[56] References Cited

U.S. PATENT DOCUMENTS

| | | | |
|---|---|---|---|
| 3,403,763 | 10/1968 | Hilpert et al. | 192/56 F X |
| 3,405,499 | 10/1968 | Dexter | 53/331.5 |
| 3,491,516 | 1/1970 | Bergeron | 53/331.5 |
| 3,807,539 | 4/1974 | Reed | 192/56 F X |
| 3,955,341 | 5/1976 | Wilhere | 53/331.5 |
| 4,222,215 | 9/1980 | Takano | 53/331.5 |
| 4,246,738 | 1/1981 | Ono | 53/331.5 |
| 4,558,554 | 12/1985 | Herbert | 53/331.5 |
| 4,715,248 | 12/1987 | Gant | 192/56 F X |
| 4,793,120 | 12/1988 | Herzog | 53/331.5 |

*Primary Examiner*—John Sipos
*Assistant Examiner*—Daniel B. Moon

[57] ABSTRACT

An improved cap disc air clutch mechanism is provided, in which a pair of improved cap disc air clutch mechanisms will sense the torque between a cap and neck of a container and will allow cap tightening discs thereon to stop once the desired torque is reached and at the same time, allow the respective spindle shafts to continue to rotate. The improved cap disc air clutch mechanisms are adjustable to different torques by varying air pressure thereto, since the torque required for caps and containers varies considerably.

3 Claims, 1 Drawing Sheet

AIR CLUTCH CAPPER SPINDLE

BACKGROUND OF THE INVENTION

The instant invention relates generally to machines for putting screw caps onto containers and more specifically it relates to an improved cap disc air clutch mechanism which provides air pressure to adjust the mechanism to sense the torque between a cap and the neck of a container.

There are available various conventional machines for putting screw caps onto containers which do not provide the novel improvements of the invention herein disclosed.

SUMMARY OF THE INVENTION

A primary object of the present invention is to provide an improved cap disc air clutch mechanism that will overcome the shortcomings of the prior art devices.

Another object is to provide an improved cap disc air clutch mechanism that is designed to act as a torque limiter by utilizing air pressure to sense the torque between a cap and a neck of a container, thereby allowing the cap tightening discs to stop once the desired torque is reached, while the spindle shaft continues to spin.

An additional object is to provide an improved cap disc air clutch mechanism that is adjustable to different torques by the use of an air pressure regulator and gauge connected by an air line to an air clutch piston which presses downwardly on a bearing on top of a friction plate assembly.

A further object is to provide an improved cap disc air clutch mechanism that is simple and easy to use.

A still further object is to provide an improved cap disc air clutch mechanism that is economical in cost to manufacture.

Further objects of the invention will appear as the description proceeds.

To the accomplishment of the above and related objects, this invention may be embodied in the form illustrated in the accompanying drawing, attention being called to the fact, however, that the drawing is illustrative only and that changes may be made in the specific construction illustrated and described within the scope of the appended claims.

BRIEF DESCRIPTION OF THE DRAWING FIGURE

FIG. 1 is a vertical cross sectional view of the instant invention with a bottle, cap and a portion of another improved cap disc air clutch mechanism in engagement shown in phantom.

DETAILED DESCRIPTION OF THE PREFERRED EMBODIMENTS

Figure 1:
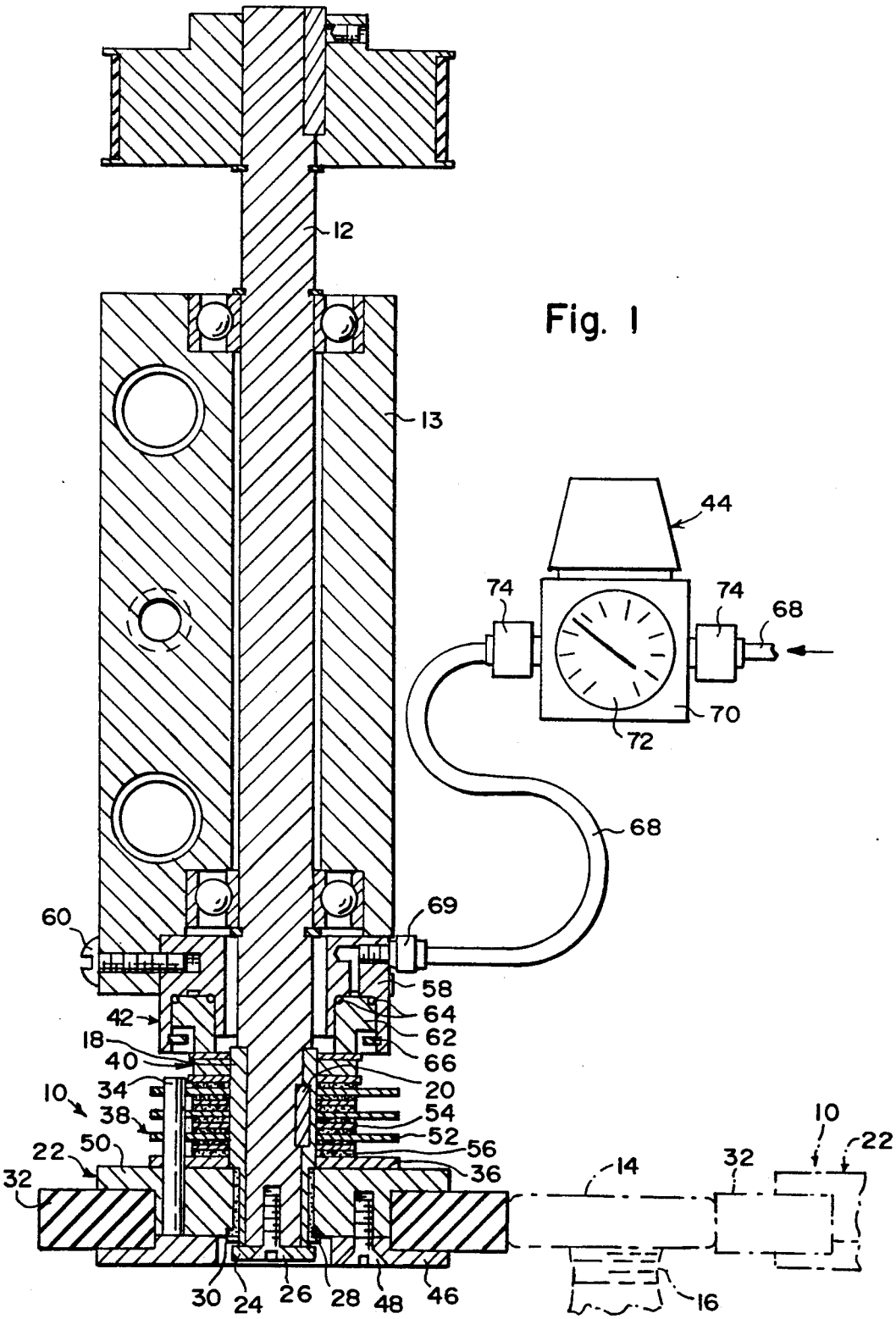

Turning now descriptively to the drawings, in which similar reference characters denote similar elements the figure illustrates an improved cap disc air clutch mechanism 10. In use a pair of spaced apart improved cap disc air clutch mechanisms 10 are provided, in which each are driven by a spindle shaft 12 carried on a spindle block 13 in a capper machine (not shown), so that both can act simultaneously, spinning in opposite directions, for engaging a cap 14 and tightening the cap 14 onto a neck of a container 16 (both shown in phantom).

Each of the improved cap disc air clutch mechanisms 10 consists of a clutch hub 18 keyed at 20 onto the spindle shaft 12 which prevents movement circumferentially between the clutch hub 18 and the spindle shaft 12. A clutch spool 22 is attached to the bottom of the spindle shaft 12 by a retaining washer 24 and clutch mounting screw 26, while at the same time is rotatable about the clutch hub 18 by a is disposed within the clutch spool 22 for engaging the cap 14. A plurality of torque pins 34 are disposed about and into the top of the clutch spool 22. A thick large plate 36 is mounted on the clutch hub 18 to sit upon the clutch spool 22 and is in engagement with the torque pins 34. A friction plate assembly 38 is mounted on the clutch hub 18 to sit upon the thick large plate 36 and is in engagement with the torque pins 34. A bearing assembly 40 is mounted on the top portion of the clutch hub 18 for rotation therewith and is engagable with the top of the friction plate assembly 38. A mechanism 42 is for applying air pressure onto the bearing assembly 40, so that the friction plate assembly 38 can provide torque to the torque pins 34 and into the clutch spool 22.

Another mechanism 44 is for varying the air pressure into the air pressure applying mechanism 42 to change tension from the clutch hub 18 through the friction plate assembly 38 and into the clutch spool 22. Both of the improved cap disc air clutch mechanisms 10 will sense the torque between the cap 14 and neck of the container 16 and will allow the cap tightening discs 32 to stop once the desired torque is reached and at the same time, allow the spindle shafts 12 to continue to rotate.

The clutch spool 22 further includes a lower detachable flange 46, so that the cap tightening disc 32 can be installed into the clutch spool 22. A plurality of lower flange screws 48 are for securing the lower flange 46 onto the upper portion 50 of the clutch spool 22 after the cap tightening disc 32 is installed thereto.

The friction plate assembly 38 includes a plurality of large plates 52, a plurality of small plates 54 and a plurality of friction pads 56. The large plates 52, the small plates 54 and the friction pads 56 are mounted o the clutch hub 18 in a stacked relationship, in which generally one of the small plates 54 sits between two of the friction pads 56 and one of the large plates 52 sits between two of the friction pads 56. The large plates 52 are in engagement with the torque pins 34, so as to provide better dissipation of heat due to friction therebetween from the friction pads 56 and better distribution of pressure to the torque pins 34.

The air pressure applying mechanism 42 includes an air clutch hub 58 mounted by a retaining screw 60 to the underside of the spindle block 13. An air clutch piston 62 is carried in the underside of the air clutch hub 58, between a pair of piston seals 64 and a retaining ring 66. An air line 68 is connected into the air clutch hub 58 by a connector 69, so that air pressure therefrom can cause the air clutch piston 62 to bear against the bearing assembly 40.

The air pressure varying mechanism 44 includes an air pressure regulator 70 having an air pressure gauge 72, which is connected into said air line 68 by connectors 74, so that the air pressure regulator 70 can vary the air pressure to the air clutch piston 62 to change the tension on the friction plate assembly 38, thereby varying the torque setting. One regulator may adjust two clutches simultaneously (not shown) while the machine is operating.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An improved cap disc air clutch mechanism driven by a spindle shaft carried on a spindle block in a capper machine, so that with another spaced apart improved cap disc air clutch mechanism simultaneously spinning in an opposite direction, will engage a cap for tightening the cap onto a neck of a container, each said improved cap disc air clutch mechanism comprises:

a) a clutch hub keyed onto the spindle shaft which prevents movement circumferentially between said clutch hub and the spindle shaft;

b) a clutch spool attached to the bottom of the spindle shaft, while at the same time rotatable about said clutch hub;

c) a cap tightening disc disposed within said clutch spool for engaging the cap;

d) a plurality of torque pins disposed about and into the top of said clutch spool;

e) a plate mounted concentrically on said clutch hub bearing on said clutch spool and in engagement with said torque pins;

f) a friction plate assembly mounted concentrically on said clutch hub engaging said plate and in engagement with said torque pins;

g) a bearing assembly mounted on a top portion of said clutch hub for rotation therewith and adjustably engageable with a top of said friction plate assembly;

h) means for applying pressure onto said bearing assembly, so that said friction plate assembly can provide torque to said torque pins and into said clutch spool; and i) means for applying air pressure to the first said means to vary pressure on said bearing assembly, to said friction plate assembly, to said plate and to said clutch spool, whereby both said clutch mechanisms will sense the torque between the cap and the neck of the container and will cause said friction plate assembly to slip and said cap tightening discs to stop tightening once the maximum desired torque is reached and at the same time, allow the spindle shafts to continue to rotate.

2. An improved cap disc air clutch mechanism as recited in claim 1, wherein said air pressure applying means includes;

a) an air clutch hub mounted fixedly on said spindle block;

b) an external air line connected to a duct in said hub; wherein said means for applying pressure to said bearing assembly includes an air clutch piston reciprocably mounted on said air clutch hub receiving air pressure from said duct and engaging said bearing assembly so that air pressure from said air clutch hub causes said air clutch piston to bear against said bearing assembly.

3. An improved cap disc air clutch mechanism as recited in claim 2, wherein said air pressure applying means includes an air pressure regulator connected into said line, so that said air pressure regulator can vary the air pressure to said air clutch piston to vary the frictional forces in said friction plate assembly, thereby varying the torque setting.

* * * * *